US005120426A

United States Patent [19]

Johnston et al.

[11] Patent Number: 5,120,426

[45] Date of Patent: Jun. 9, 1992

[54] HYDROCRACKING PROCESS

[75] Inventors: Mark R. Johnston, Westminster, Calif.; Donald J. Gatza; Mark J. Woodward, both of Bellingham, Wash.

[73] Assignee: Atlantic Richfield Company, Los Angeles, Calif.

[21] Appl. No.: 631,616

[22] Filed: Dec. 21, 1990

[51] Int. Cl.[5] ..... C10G 45/72; C10G 37/00

[52] U.S. Cl. ..... 208/100; 208/108; 208/102; 208/103; 208/104; 208/48 R

[58] Field of Search ..... 208/100, 48 R, 102

[56] References Cited

U.S. PATENT DOCUMENTS

| | | | |
|---|---|---|---|
| 3,598,720 | 8/1971 | Stolfa | 208/100 |
| 3,619,407 | 11/1971 | Hendricks et al. | 208/48 |
| 3,691,063 | 9/1972 | Kirk | 208/91 |
| 4,411,768 | 10/1983 | Unger et al. | 208/59 |
| 4,447,315 | 5/1984 | Lamb et al. | 208/99 |
| 4,618,412 | 10/1986 | Hudson et al. | 208/59 |
| 4,655,903 | 4/1987 | Rahbe et al. | 208/58 |
| 4,698,146 | 10/1987 | Gruia | 208/100 |
| 4,775,460 | 10/1988 | Reno | 208/91 |
| 4,902,405 | 2/1990 | MacLean et al. | 208/59 |
| 4,921,595 | 5/1990 | Gruia | 208/59 |
| 4,931,165 | 6/1990 | Kalnes | 208/100 |
| 4,954,242 | 9/1990 | Gruia | 208/102 |
| 4,961,834 | 10/1990 | Stine et al. | 208/102 |
| 5,007,998 | 4/1991 | Gruia | 208/100 |

OTHER PUBLICATIONS

Encyclopedia of Chemical Processing and Design, Executive Editor John J. McKetta; "Hydrocracking", vol. 26, pp. 424–466.

*Primary Examiner*—Helane Myers

*Attorney, Agent, or Firm*—Tom F. Pruitt

[57] ABSTRACT

An improved hydrocracking process, in a process for conversion of components of a heavy hydrocarbon feed to lighter, more valuable products, wherein the feed comprises foulant, the process comprising: (a.) contacting the feed with hydrogen, in the presence of a hydrocracking catalyst, at an elevated temperature and pressure in a hydrocracker, to produce a hydrocracker effluent comprising foulant; (b.) cooling and depressurizing the hydrocracker effluent to form a cooled, depressurized hydrocracker effluent comprising foulant; (c.) separating the cooled, depressurized hydrocracker effluent into the products of the conversion and an unconverted portion of the hydrocracker effluent which comprises foulant; and (d.) recycling, as effluent recycle to the hydrocracker, the unconverted portion of the hydrocracker effluent to the hydrocracker, wherein the concentration of foulant in the hydrocracker effluent is increased; the improvement comprising: (i.) partially cooling the hydrocracker effluent in a first cooler to a temperature at which the foulant remains soluble in the hydrocracker effluent to form a first cooled stream comprising unprecipitated foulant; (ii.) withdrawing a withdrawn portion of the first cooled stream and cooling the withdrawn portion to a temperature, below the temperature of the first cooled stream, at which foulant precipitates to form a second cooled stream comprising precipitated foulant; (iii.) removing the precipitated foulant from the second cooled stream to form a third cooled stream having a reduced concentration of foulant; and, (iv.) recycling the third cooled stream to the hydrocracker to reduce the concentration of foulant in the hydrocracker effluent.

40 Claims, 2 Drawing Sheets

HYDROCRACKING PROCESS

BACKGROUND OF THE INVENTION

1. Field of the Invention

This invention relates to improvements in the catalytic hydrocracking of heavy hydrocarbon feeds to produce lower boiling products. In one aspect, this invention relates to removal of foulant from hydrocracking process streams. In still another aspect, this invention relates to a method of reducing fouling of hydrocracking process equipment.

2. Description of the Related Art

Hydrocracking converts components of a heavy hydrocarbon feed to lighter, more valuable products by contacting the feed with hydrogen, in the presence of a hydrocracking catalyst, at an elevated temperature and pressure. The hydrocracker effluent is cooled and depressurized, and the products of the conversion are separated from unconverted compounds.

The unconverted portion of the reactor effluent is recycled through the reactor to seek complete conversion. The unconverted-recycled portion contains convertible hydrocarbons which are converted during a subsequent pass through the reactor; however, it also contains hydrocarbons, which are substantially or wholly nonconvertible, which are resistant to cracking at hydrocracking conditions and hydrocarbons which are not cracked during recycling since they will not crack under hydrocracking conditions. As a result of the recycle, these cracking-resistant and noncracking compounds increase in concentration in the reactor effluent and become foulants. The foulants cause problems, as they accumulate in the process and precipitate during cooling of the reactor effluent since the foulants have a relatively low solubility in the reactor effluent. The precipitated foulants deposit in the cooling equipment and in cooler process piping. As a result, the hydrocracker runs are shortened, adversely impacting equipment utilization and process economics.

Although hydrocrackers can be designed to operate with a variety of feeds, catalysts, equipment configurations, and other design parameters, the fouling problems associated with hydrocrackers employing recycle streams is well-known to those skilled in the art.

Prior art methods addressed to the problems associated with hydrocracker fouling, have sought to reduce the concentration of polycyclic compounds, principally heavy polynuclear aromatic compounds ("HPNAs"), in hydrocracker streams. In prior art processes, it has been conventional to minimize the concentration HPNAs by hydrogenation or other conversion of those compounds.

U.S. Pat. No. 4,921,595 to Gruia claimed reduction of the concentration of 11+ ring HPNAs in a hydrocracking effluent by converting the compounds by hydrogenation using a zeolitic hydrogenation catalyst having pore openings in the range of about 8 to about 15 Angstroms and a hydrogenation component operated at the specified conditions to reduce the concentration of the HPNAs.

U.S. Pat. No. 4,931,165 to Kalnes claims a method of reducing hydrocracker process unit fouling by flashing a slipstream of recycled hydrocarbon liquid containing HPNAs with a hydrogen-rich gaseous stream to generate a concentrated liquid stream of HPNAs and a vaporized stream containing hydrogen and having a reduced concentration of HPNAs. The resulting vaporized streams are hydrogenated in a hydrogenation zone to convert and thereby further lower the concentration of the HPNAs.

U.S. Pat. No. 3,691,063 to Kirk teaches removal of asphaltic material from hydrocracker feed by use of a guard case containing high surface area catalysts such as alumina and various acid cracking catalysts such as silica alumina and various modified silica aluminas including zeolites. The guard case is operated at a temperature of 600° F. to 1,000° F. and a pressure in the range of about 10 to 50 psig.

U.S. Pat. No. 4,618,412 to Hudson, et al., removes polynuclear aromatic hydrocarbon compounds to suppress fouling of the hydrocracker unit by contacting such compounds with an iron catalyst in the presence of hydrogen to hydrogenate and hydrocrack and convert the material to be removed.

U.S. Pat. No. 4,447,315 to Lamb, et al., claims reducing the concentration of polynuclear aromatic compounds by contacting the unconverted hydrocarbon stream with an adsorbent which selectively retains polynuclear aromatic compounds. Lamb et al. discloses that the adsorbent can be silica gel, activated carbon, activated alumina, clay and the like.

U.S. Pat. No. 4,411,768 to Unger, et al., is relevant for its teaching, in a hydrogenation process, the treating of liquid recycle streams to remove coke precursors by cooling the liquid recycle in to a temperature of from 350° F. to 600° F., with such cooling separating coke precursors from the liquid recycle. Coke precursors, which are characterized by Unger as being toluene insolubles and heptane insolubles, precipitate from the liquid recycle at such cool temperatures. Removal of the coke precursors was by filtration, centrifugation or by adding a low-boiling liquid to the liquid recycle to reduce the solubility of the coke precursors.

U.S. Pat. No. 3,619,407 to Hendricks, et al., reduces polycyclic aromatic hydrocarbons, characterized as benzocoronenes, from hydrocracking effluent by partially cooling the effluent to condense a portion of the normally liquid hydrocarbons to form a benzocoronene-rich partial condensate and withdrawing a bleedstream of the benzocoronene-rich material from the reactor effluent.

U.S. Pat. No. 4,775,460 to Reno teaches removal of polycyclic aromatics by a two-step procedure. The first step of the procedure comprises contacting the hydrocarbon feedstream with a material which promotes the formation of the polycyclic aromatic hydrocarbons at conditions of elevated temperature but which are mild (low pressure) relative to hydrocracking conditions, and the second step of the procedure is removal of the polycyclic hydrocarbons by an absorbent material such as activated charcoal.

U.S. Pat. No. 4,902,405 to MacLean, et al., removes materials, from a hydrocracking zone product stream, having a boiling range from about 500° F. to about 650° F., which MacLean et al believed to contain precursors for heavy materials boiling over 1050° F., and materials having an initial boiling point above 1050° F.

Other methods to reduce hydrocracker system fouling are needed.

SUMMARY OF THE INVENTION

The invention is an improved hydrocracking process. One embodiment of this invention is a catalytic hydrocracking process comprising: (a.) contacting a hydrocarbon feed comprising foulant in a hydrocracking zone with added hydrogen in the presence of a hydrocracking catalyst at an elevated temperature and pressure, sufficient to cause substantial conversion of the feed to lower boiling products, to produce a hydrocracking zone effluent comprising converted products, unconverted hydrocarbons and foulant; (b.) cooling in a first cooler the hydrocracking zone effluent to a first temperature at which the foulant is soluble in the effluent to effect condensation of a condensed stream comprising soluble foulant; (c.) depressurizing the condensed stream to form a depressurized condensed stream comprising soluble foulant; (d.) cooling in a second cooler a portion of the depressurized condensed stream to a second temperature, below the first temperature of the condensed stream, at which precipitation of foulant occurs to form a low temperature stream comprising precipitated foulant; (e.) removing at least a portion of the precipitated foulant from the low temperature stream to form a reduced foulant recycle stream; (f.) fractionating a fresh hydrocarbon feed comprising foulant, the depressurized condensed stream comprising soluble foulant and the reduced foulant recycle stream in to a first fraction comprising lower boiling products and a second fraction comprising unconverted hydrocarbons and foulant; and, (g.) recycling the second fraction to the hydrocracking zone as hydrocarbon feed. In a variation of this embodiment of this invention, the hydrocracking zone effluent is cooled to a first temperature in the range of about 170° F. to about 300° F. In another variation, the depressurized condensed stream is cooled to a second temperature in the range of about 85° F. to about 170° F. In still another variation, the portion of precipitated foulant removed from the low temperature stream is in an amount at least equal to an amount sufficient to maintain the concentration of foulant in the condensed stream at the first temperature below the soluble concentration of foulant in the condensed stream at the first temperature. The soluble concentration is defined to be the concentration at which foulant becomes insoluble in the condensed stream and begins to precipitate out. In a preferred variation of this embodiment, the second cooler is operated such that the precipitated foulant forms, or plates out, a foulant precipitate in the second cooler and the foulant precipitate is removed from the second cooler. In still another variation of this embodiment, a portion of the reduced foulant recycle stream is fed to the hydrocracking zone as hydrocarbon feed. In this embodiment, it is preferred that the fresh hydrocarbon feed comprises a component selected from the group consisting of atmospheric gas oil, vacuum gas oil, cracked gas oil, catalytic cycle oil, and coker gas oil. The fresh hydrocarbon feed may comprise hydrotreated hydrocarbon feed in still more preferred variations of this embodiment. In a still further preferred variation, the fresh hydrocarbon feed comprises hydrocracked hydrocarbon feed. The hydrocracking zone is preferably maintained at an elevated total pressure in the range of about 1,000 psia to 3,000 psia. Preferably, the condensed stream is depressurized from a hydrocracking zone pressure in the range of about 1,000 psia to 3,000 psia to a pressure in the range of about 0 psia to about 300 psia. In a preferred variation of this embodiment, the hydrocracking zone is maintained at an elevated temperature in the range of about 450° F. to about 850° F. Preferably, the hydrocracking catalyst comprises palladium and a zeolite base.

In another embodiment of this invention, a hydrocracking process for converting a hydrocarbon feed into lighter petroleum products, wherein the feed comprises a foulant, comprises: (a.) feeding the hydrocarbon feed and hydrogen to a hydrocracking zone having a hydrocracking catalyst at hydrocracking conditions of elevated temperature and pressure to produce a hydrocracking effluent stream comprising foulant; (b.) cooling the hydrocracking effluent stream in a first cooler to a temperature in the range of about 170° F. to about 300° F. to form a first cooled stream comprising soluble foulant; (c.) reducing the pressure of the first cooled stream to a pressure in the range of about 0 psia to about 300 psia to form a depressurized stream comprising soluble foulant; (d.) separating the depressurized stream into a first portion comprising soluble foulant and a second portion comprising soluble foulant; (e.) cooling the second portion of the depressurized stream in a second cooler to a temperature in the range of about 85° F. to about 170° F. to form a colder second portion comprising precipitated foulant; (f.) removing the precipitated foulant from the colder second portion to form a reduced foulant colder second portion; (g) feeding the reduced foulant colder second portion and the first portion of the depressurized stream to a fractionating zone; (h.) feeding the first portion and the reduced foulant colder second portion as feed to a fractionating zone; (i) fractionating the first portion and the reduced foulant colder second portion in to a lighter petroleum product fraction and a heavier fraction comprising foulant; and (i) recycling the heavier fraction to the hydrocracker. In a variation of this embodiment of this invention, the precipitated foulant forms a foulant precipitate in the second cooler and the foulant precipitate is removed from the second cooler. In another variation of this embodiment, the foulant precipitate is removed from the second cooler and the precipitated foulant is removed from the colder second portion to maintain the concentration of foulant in the depressurized stream below the concentration at which foulant is no longer soluble in the depressurized stream. In another variation, the hydrocarbon feed to the hydrocracking zone comprises a portion of the reduced foulant colder second portion.

An additional embodiment of this invention is a hydrocracking process for conversion of a heavy hydrocarbon feed to a lower boiling product, wherein the heavy hydrocarbon feed comprises foulant, wherein the process comprises: (a.) contacting the heavy hydrocarbon feed in a hydrocracker with a hydrogen-rich first gas fraction in the presence of a hydrocracking catalyst at hydrocracking conditions to convert the heavy hydrocarbon feed to a hydrocracker product stream; (b.) cooling the hydrocracker product stream in a first cooler to a first cool temperature at which foulant remains soluble in the hydrocracker product stream to form a cooled hydrocracker product stream comprising soluble foulant; (c.) separating the cooled hydrocracker product stream in a first separation zone in to a first gas fraction comprising hydrogen and a first separation zone liquid effluent comprising soluble foulant; (d.) adjusting the concentration of hydrogen in the first gas fraction to form a hydrogen-rich first gas fraction; (e.) recycling the hydrogen-rich first gas fraction to the hydrocracker; (f.) separating the first separation zone liquid effluent in a second separate separation zone in to a second gas fraction and a second separation zone liquid effluent comprising soluble foulant; (g.) separating the second separation zone liquid effluent in to a first portion comprising soluble foulant and a second portion comprising soluble foulant; (h.) cooling the second portion of the second separation zone liquid effluent in a second cooler to a second cool temperature sufficient to precipitate foulant from the second portion to form foulant precipitate; (i.) removing the foulant precipitate from the second portion of the second separation zone liquid effluent and separating the second portion of the second separation zone liquid effluent in to a foulant-lean stream and a foulant-rich stream; (j) withdrawing the foulant-rich stream from the process; (k) feeding the first portion of second separation zone liquid effluent and the foulant-lean stream as feed to a fractionation zone for fractionization in to a heavy hydrocarbon fraction containing foulant and a lower boiling point fraction; (l.) recycling the heavy hydrocarbon fraction to the hydrocracker as hydrocarbon feed; and (m.) recovering the lower boiling fraction as a lower boiling product. In one variation of this embodiment, the foulant precipitate precipitates in the second cooler and the foulant precipitate is removed from the second cooler. In still another variation of this embodiment of this invention, the foulant precipitate is removed from the second cooler and the second separation zone liquid effluent to maintain the concentration of foulant in the cooled hydrocracker product stream below the concentration at which foulant is no longer soluble in the cooled hydrocracker product stream. In other variations, the hydrocarbon feed to the hydrocracker comprises (i) a portion of the foulant lean stream; (ii) fresh hydrocarbon feed comprising a component selected from the group consisting of atmospheric gas oil, vacuum gas oil, cracked gas oil, catalytic cycle oil, and coker gas oil; (iii) fresh hydrocarbon feed comprising hydrotreated hydrocarbon feed; or (iv) fresh hydrocarbon feed comprising hydrocracked hydrocarbon feed, or mixtures of the foregoing. And in still another variation, hydrocracking conditions include operating at an elevated pressure in the range of about 1,000 psia to 3,000 psia and an elevated temperature in the range of about 450° F. to about 850° F. It is preferred that the hydrocracking catalyst comprises palladium and a zeolite base.

Another embodiment of this invention is an improved hydrocracking process, in a process for conversion of components of a heavy hydrocarbon feed to lighter, more valuable products, wherein the feed comprises foulant, the process comprising: (a.) contacting the feed with hydrogen, in the presence of a hydrocracking catalyst, at an elevated temperature and pressure in a hydrocracker, to produce a hydrocracker effluent comprising foulant; (b.) cooling and depressurizing the hydrocracker effluent to form a cooled, depressurized hydrocracker effluent comprising foulant; (c.) separating the cooled, depressurized hydrocracker effluent in to the products of the conversion and an unconverted portion of the hydrocracker effluent which comprises foulant; and, (d.) recycling, as effluent recycle to the hydrocracker, the unconverted portion of the hydrocracker effluent to the hydrocracker, wherein the concentration of foulant in the hydrocracker effluent is increased; the improvement comprising: (i.) partially cooling the hydrocracker effluent in a first cooler to a temperature at which the foulant remains soluble in the hydrocracker effluent to form a first cooled stream comprising unprecipitated foulant; (ii.) withdrawing a withdrawn portion of the first cooled stream and cooling the withdrawn portion to a temperature, below the temperature of the first cooled stream, at which foulant precipitates to form a second cooled stream comprising precipitated foulant; (iii.) removing the precipitated foulant from the second cooled stream to form a third cooled stream having a reduced concentration of foulant; and, (iv.) recycling the third cooled stream to the hydrocracker to reduce the concentration of foulant in the hydrocracker effluent.

Another embodiment of this invention is an improved catalytic hydrocracking process for converting a heavy hydrocarbon feed comprising foulant to lower boiling products, comprising: (a.) contacting the feed and a products, comprising: (a.) contacting the feed and a hydrogen-rich gas, in a hydrocracker, in the presence of a hydrocracking catalyst at hydrocracking temperature and pressure to produce a hydrocracker effluent comprising converted components of the feed and unconverted components of the feed comprising foulant; (b) cooling the hydrocracker effluent; (c) passing the hydrocracker effluent to a high pressure separator where the hydrocracker effluent is depressurized to a first pressure and separated into a hydrocarbon liquid effluent stream and a hydrogen-rich gas; (d.) recycling the hydrogen-rich gas to the hydrocracker; (e.) passing the hydrocarbon liquid effluent stream to a low pressure separator where the hydrocarbon liquid effluent is depressurized to a second pressure and light gases are separated from the hydrocarbon liquid stream to form a low pressure hydrocracker product stream; (f.) fractionating the low pressure hydrocracker product stream in a fractionation zone to separate the low pressure hydrocracker product stream into desired lighter product cuts and a heavy bottoms stream containing unconverted hydrocarbons comprising foulant; (g.) recycling the heavy bottoms stream to the hydrocracking zone; the improvement comprising, (i.) cooling the hydrocracker effluent in a first cooler to a temperature at which foulant remains soluble in the hydrocracker effluent to form a first cooled stream comprising unprecipitated foulant; (ii) passing the first cooled stream to a high pressure separator where the first cooled stream is depressurized to a first pressure and separated in to a hydrocarbon liquid effluent stream comprising unprecipitated foulant and a hydrogen-rich gas; (iii.) recycling the hydrogen-rich gas to the hydrocracker; (iv.) passing the hydrocarbon liquid effluent stream to a low pressure separator where the hydrocarbon liquid effluent stream is depressurized to a second pressure and light gases are separated from the hydrocarbon liquid effluent stream to form at a cool temperature a low pressure hydrocracker product stream comprising unprecipitated foulant; (v.) withdrawing a withdrawn portion of the low pressure hydrocracker product stream and cooling in a second cooler the withdrawn portion to a temperature, below the cool temperature of the low pressure hydrocracker product stream, at which foulant precipitates to form a foulant precipitate in the second cooler and a second cooled stream comprising precipitated foulant; (vi.) removing the foulant precipitate from the second cooler; (vii.) removing the precipitated foulant from the second cooled stream to form a third cooled stream having a reduced concentration of foulant; and, (viii.) recycling the third cooled stream to the hydrocracking zone.

We have discovered that if foulant is removed from the recycled hydrocracker effluent stream at the same rate foulant is fed in the fresh hydrocarbon feed or is generated in the hydrocracker, then an equilibrium concentration of foulant can be maintained in the hydrocracker effluent and precipitation of foulant at undesired process locations can be avoided. We have also discovered that foulant can be removed from any location in the recycle loop in which hydrocracker effluent is recycled. This discovery permits installation of foulant removal apparatus at process points where both temperature and pressure are substantially below prior art foulant removal locations. We have also found that a series of hydrocracking effluent coolers can be preferably used to effect the selection of an exit temperature of a first cooler wherein foulant can remain soluble in the recycled process stream exiting the first cooler. A second cooler, which in one variation of an embodiment of this invention comprises an automatic cleaning system, is preferably be used to precipitate foulant and remove foulant from the process and recycle to the hydrocracker a substantial portion of hydrocracker effluent passed through the second cooler, without withdrawing excessive hydrocracking effluent from the process.

The term "foulant" as used in the specification and the claims means polycyclic aromatics, precursors for the formation of polycyclic aromatics, coke precursors, and other compounds which precipitate in the hydrocracker effluent stream during cooling of the effluent stream. Polycyclic aromatics include polynuclear aromatic hydrocarbon compounds (PNAs), which include polynuclear aromatic hydrocarbons comprising two or more bonded rings. Such polynuclear aromatic hydrocarbons include naphthalenes and indenes (2-rings), anthracenes, phenanthrenes, fluorenes and acenaphthenes (3-rings), benzanthracenes, benzphenanthrenes, perylenes, tetracenes and pyrenes (4-rings), benzopyrenes, benzoperylenes, pentacenes and dibenzanthracenes (5-rings), coronenes (6-rings), benzocoronenes (7-rings) and others. Foulant also includes precursors to foulant such as partially hydrogenated derivatives of the polynuclear aromatic hydrocarbons in which one or more of the aromatic rings has been hydrogenated. Foulant has a limited solubility in hydrocracker hydrocarbon feedstreams. Foulant may naturally occur in the hydrocarbon feedstock or can be formed by thermal condensation of precursors and other reactions in hydrotreating reactors and other feed pretreaters. Foulant has a relatively wide boiling range.

These and other objects, advantages, details, features, and embodiments of this invention will become apparent to those skilled in the art from the following detailed description of the invention, the appended claims, and the drawings.

BRIEF DESCRIPTION OF THE DRAWINGS

In the accompanying drawings.

DESCRIPTION OF THE PREFERRED EMBODIMENTS

The invention is illustrated with reference to the drawings wherein, for purposes of illustration of the preferred embodiments, it being understood that this invention is not limited thereto.

Figure 1:
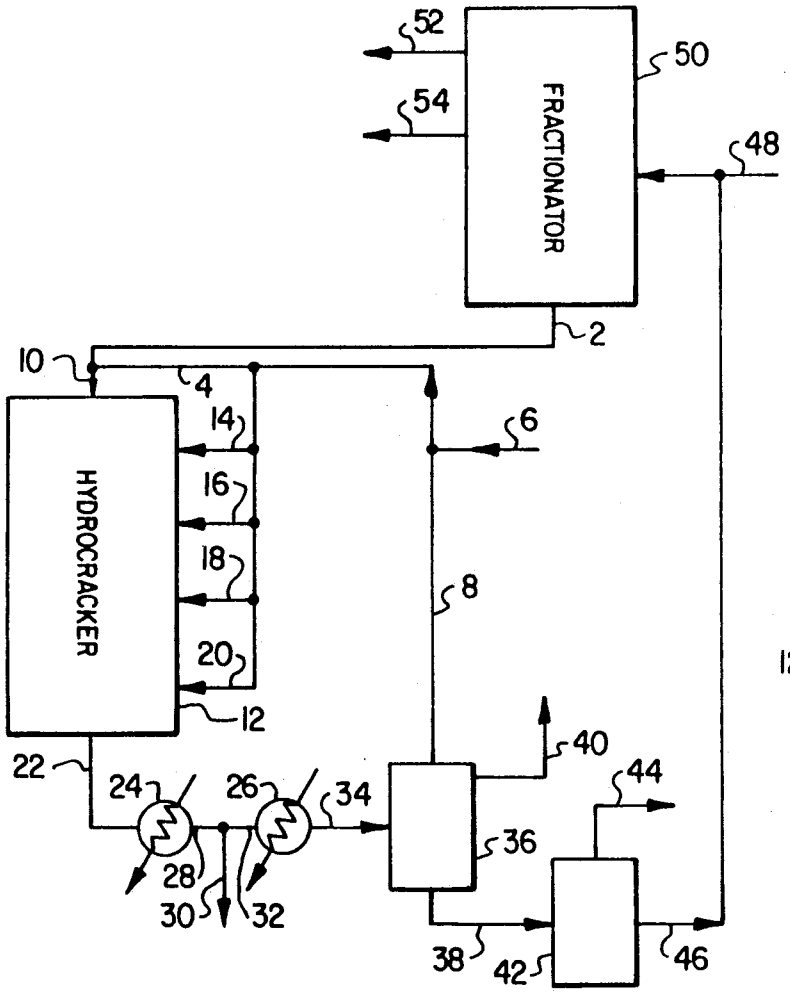
FIG. 1 (PRIOR ART)
FIG. 1 is a schematic representation of a prior art hydrocracking process for converting hydrocarbon feed to lower boiling products.

FIG. 1 is a prior art single stage hydrocracking process. Hydrocarbon feed containing foulant 2 is combined with a mixture 4 of makeup, added hydrogen 6 and a hydrogen-rich recycle gas 8. The combined feedstream 10 is heated (heater not shown) to the desired reactor inlet temperature and fed to the hydrocracking zone 12. Generally, the hydrocracking reactor 12 is loaded with hydrocracking catalyst (not shown) where the catalyst is loaded in separate beds or segments in the reactor, with multiple hydrogen injection facilities 14, 16, 18, and 20 between the segments for cooling the reaction mix with hydrogen streams.

Hydrocracking catalysts for use in hydrocracker 12, and methods for preparing such catalysts, are well-known in the art. Hydrocracking catalysts generally comprise a natural or synthetic zeolite cracking base, and incorporate a Group VIII active metal hydrogenating component; eg., iron, cobalt, nickel, palladium, platinum and others, and may incorporate one or more metal promoters, including the metals of Group VIB; eg., molybdenum and tungsten and may incorporate an alumina binder. The amount of hydrogenating metal in the hydrocracking catalyst can vary within wide ranges. Generally, any amount between 0.005 percent and 30 percent by weight may be used. The zeolite bases are usually comprised of silica, alumina, and one or more exchangeable cations such as sodium, hydrogen, magnesium, calcium, and rare earth metals. One preferred hydrocracking catalyst comprises nickel and molybdenum supported on a zeolite base. Such preferred catalysts contains from about 6.0 to about 7.0 percent nickel and from about 9.0 to about 11.0 percent molybdenum and are commercially available. One such preferred catalyst is HC-14, available from UOP, 12399 Lewis Street, Suite 201, Garden Grove, Calif. 92640. A still more preferred hydrocracking catalyst comprises palladium supported on a zeolite base, and preferably comprises an alumina binder.

Hydrocracking conditions in hydrocracker 12 are determined by the type of feedstock, product slate desired, age of the catalyst, and other variables, and are well know in the art. Hydrocracking conditions are at an elevated temperature and pressure sufficient to cause substantial conversion of the hydrocarbon feed to a lower boiling product. The term "hydrogen-rich gas" means a gaseous stream that comprises at least 70 volume percent hydrogen. Hydrocracking conditions typically are a total pressure from about 1,000 to about 3,000 pounds per square inch absolute (psia), a hydrogen partial pressure of about 1,000 to about 2,000 psia, a temperature from about 450° F. to about 850° F., a residence time of from about 5.0 to about 10.0 minutes. For a jet fuel product, preferred conditions in a hydrocracker are a total pressure of about 1,800 psia, a hydrogen partial pressure of about 1,625 psia and a temperature of about 500° to about 700° F. and a residence time of about 7.0 minutes. It is well-known to those skilled in the art that hydrocracking conditions will vary depending upon the feedstock charged to the reactors, condition of the catalyst beds in the reactors and other factors. For instance, temperatures exceeding about 850°

F. result in thermal cracking of the feed resulting in fouling of catalyst and temperatures below about 250° F. result in uneconomically slow reaction rates and significantly increased residence time. While the single-stage hydrocracker 12 has been shown in FIG. 1 as one vessel, it is well understood that a plurality of vessels could be used for one stage of hydrocracking.

The hydrocracking product stream 22 is cooled in coolers 24 and 26. In prior art process such as U.S. Pat. No. 3,619,407 to Hendricks et al,, the stream 28 exiting cooler 24 is cooled to a temperature in the range of about 400° F. to 550° F. and the stream 34 exiting cooler 26 is cooled typically to a temperature from about 100° F. to about 150° F. And in accordance with U.S. Pat. No. 3,619,407 to Hendricks et al, in cooler 24, a portion of the reactor effluent 22 is condensed to form a foulant rich partial condensated 28. A portion of the foulant rich partial condensate 28 is withdrawn as a bleed-stream 30 from the system. The remaining 32 of the partial condensate 28 is condensed in cooler 26 and passed to a high pressure separator 36. In the high pressure separator 36, the condensed reactor effluent 34 is depressurized to a first desired pressure, which first pressure is generally selected so that the pressure in the high pressure separator 36 is substantially at or near the pressure of the hydrocracking zone 12, and the effluent 34 is separated into a hydrocarbon liquid effluent stream 38 and a hydrogen-rich gas 8, which is compressed by a compressor (not shown) and recycled to the reactor 12. To maintain the concentration of hydrogen in the hydrocracker 12 and high pressure separator 36 at the level known in the art for the desired process conditions, added hydrogen 6 is introduced as necessary to makeup for hydrogen consumed in the hydrocracker and excess hydrogen is vented as a hydrogen-rich stream 40 and withdrawn from the process. With sour hydrocarbon feeds 2, the recycled gas 8 may be scrubbed, such as by scrubbing with an amine scrubber, to remove sulfur-containing compounds. The hydrocarbon liquid effluent stream 38 is passed to a low pressure separator 42 where it is further depressurized to a second desired pressure and light gases 44 are flashed off from the hydrocarbon liquid stream 38. The resulting low pressure hydrocarbon stream 46 is then fed to a fractionating column 50, either separately or combined with fresh hydrocarbon feed 48. Fresh hydrocarbon feed 48 to the fractionator 50 can comprise a component selected from the group consisting of atmospheric gas oil, vacuum gas oil, cracked gas oil, catalytic cycle oil, and coker gas oil. In the fractionator 50, the hydrocarbon streams 46 and 48 are separated into gaseous products 52 and desired lighter liquid products cuts 54 and a heavy bottoms stream 2. The heavy bottoms stream contains the heavier components of the unconverted feed 48 and heavy unconverted hydrocarbons including nonconvertible foulants in the liquid hydrocarbon effluent stream 46. The column heavy bottoms stream 2 is recycled back to the hydrocracker as feed. The recycle cut point may be changed, depending on the products 52 and 54 desired. Recycle cut point temperatures above the range of about 500° F. to about 550° F. are selected for jet fuel product and above about 300° F. to about 350° F. are selected for naphtha. The column bottoms stream 2, which is recycled to the hydrocracker 12, thus contains higher boiling hydrocarbons which include unconverted hydrocarbons which can be converted upon one or more passes through the hydrocracker and include noncracking and cracking resistant foulants.

In the practice of the prior art processes as shown in FIG. 1, it has been found that when all of the product stream 34 and 46 from the hydrocracker 12 is recycled to process all of the stream charged to the hydrocracker 12 to seek to complete conversion of the heavier materials to lighter products, foulant materials accumulate in the process 46 until the foulant concentration exceeds its limit of solubility and the foulant precipitates in the cooler process elements such as the coolers 24 and 26. This precipitation, if allowed go continue, results in plugging of the process equipment and shutting down of the process. In prior art processes, as described in U.S. Pat. No. 3,619,407 to Hendricks, et al., a cooled stream 30 is withdrawn from the hydrocracker product stream in amounts sufficient to reduce the amount of foulant. Since the concentration of foulant in the hydrocracker effluent is relatively low, large amounts of the withdrawn stream 30 have to be removed from the hydrocracking recycle and transferred to other uses. Many of the other uses utilize the withdrawn stream as fuel or to produce secondary, less valuable products. The removal of this withdrawn portion 30 is detrimental to process efficiency as it reduces the amount of hydrocracker effluent available for recycle and results in a loss of desired product to lower value uses, and an economic disadvantage is incurred.

Figure 2:
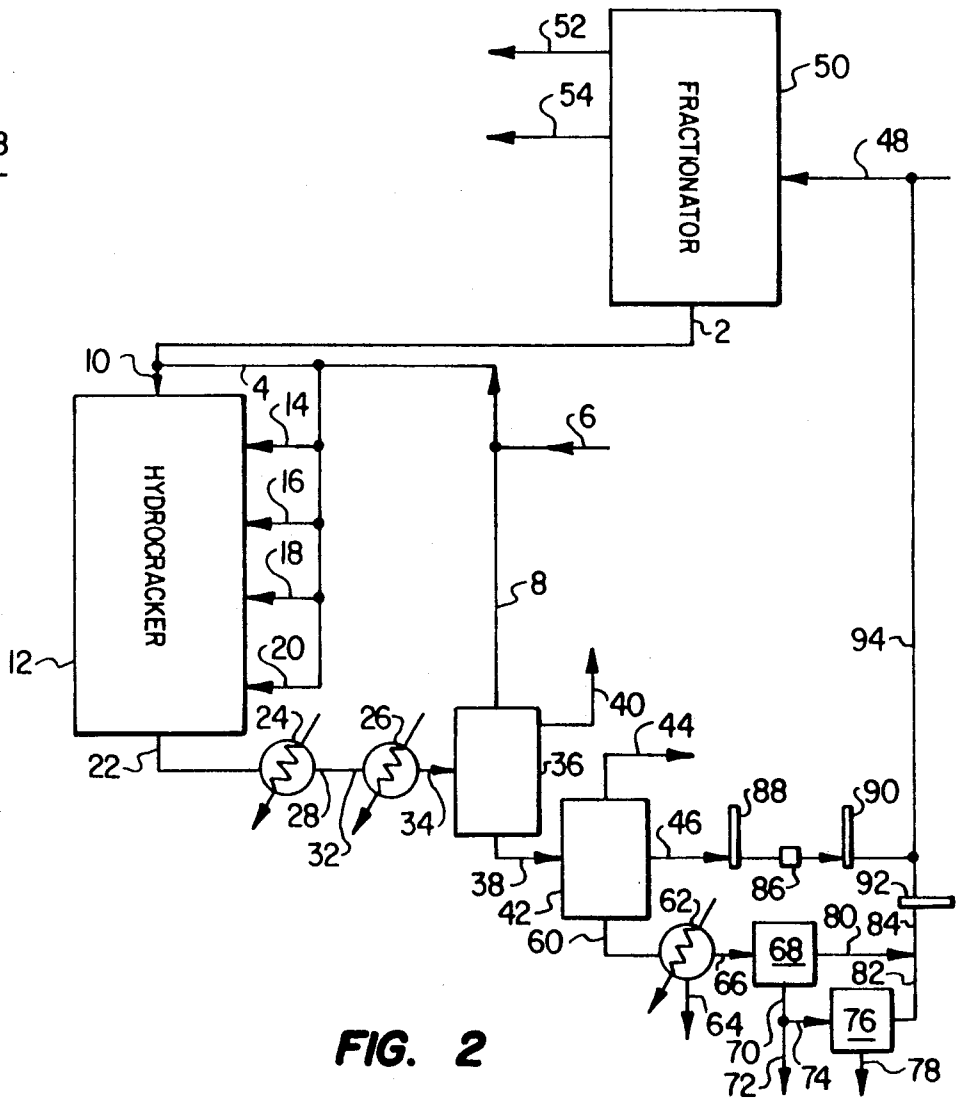
FIG. 2 is schematic representation of one embodiment of a catalytic hydrocracking process of this invention; and, FIG. 3 is schematic representation of another embodiment of this invention in a multi-stage hydrocracking process having multi-stage fractionation.

FIG. 2 is an embodiment of this invention, being an improved hydrocracking process. In the discussion of FIG. 2, the same numbers as used in FIG. 1 will be used in FIG. 2 to refer to the same or similar items. FIG. 2 shows one embodiment of an improved catalytic hydrocracking process for converting a heavy hydrocarbon feed 2 to lower boiling products 44, 52 and 54. A portion, or all if desired, of the fresh hydrocarbon feed 48 can be fed directly to the hydrocracker 12. Fresh hydrocarbon feed 48 can comprise a component selected from the group consisting of atmospheric gas oil, vacuum gas oil, cracked gas oil, catalytic cycle oil, and coker gas oil. Preferably, to reduce the deactivation rates of the hydrocracking catalyst, the hydrocarbon feed 2 to the hydrocracker 12 comprises a hydrotreated hydrocarbon stream. The preferred hydrotreated hydrocarbon stream is a product from a hydrotreating process reactor (not shown) in which a component of the feed has been subjected to desulfurization or denitrogenation, or both, at hydrotreating conditions in the presence of a hydrotreating catalyst. Such hydrotreating processes are well known in the art. One such hydrotreating process is described in U.S. Pat. No. 4,902,405 to MacLean, et al. In a preferred variation of this invention, the fresh hydrocarbon feed 48 to the fractionator 50 comprises a hydrotreated hydrocarbon stream. In another variation of this embodiment, the hydrocarbon feed comprises a hydrocracked hydrocarbon stream such as stream 2, which hydrocracked stream may be fed to the fractionator 50 or directly to the hydrocracker 12. In still another variation of this embodiment, the hydrocarbon fee 2 comprises products 52 and 54 of another hydrocracker (not shown) in a separate hydrocracking step or stage. In variations of this embodiment of this invention, the heavy hydrocarbon feed 2 may comprise unfractionated fresh feed 48 (conduit not shown) or unfractionated hydrocracker effluent 46 (conduit not shown), or both, depending on desired operating conditions. To the hydrocracking zone 12, the hydrocarbon feed 2 and a hydrogen-rich gas 4, 14, 16, 18, and 20 are fed, in the presence of a hydrocracking catalyst (not shown) as described herein at hydrocracking temperature and pressure to produce a hydrocracker effluent 22 comprising converted and unconverted components, including a foulant, of the feed 2. In one preferred variation of this embodiment, hydrocracking conditions are a total pressure from about 1,000 to about 3,000 psia, a hydrogen partial pressure of about 1,000 to about 2,000 psia, a temperature from about 450° F. to about 850° F., a residence time of time of from about 5.0 to about 10.0 minutes. In a still more preferred variation of this embodiment, preferred hydrocracking conditions in the hydrocracker 12 are a total pressure of about 1,800 psia, a hydrogen partial pressure of about 1,625 psia and a temperature of about 500 to about 700° F. and a residence time of about 7.0 minutes. The hydrocracker effluent 22 is cooled in coolers 24 and 26. In one variation of this embodiment, coolers 24 and 26 are operated such that the temperature of the process stream 34 exiting cooler 26, and the resulting hydrocracking effluent stream 34 is at a temperature in the range of about 170° F. to about 300° F. and a first cooled stream 34 comprising soluble foulant is formed. The coolers 24 and 26 are preferably operated at a exit temperature of the process stream wherein the foulant substantially remains in solution cooled hydrocracker effluent 34. The cooled process stream 34 is passed to a high pressure separator 36 where the hydrocracker effluent 34 is depressurized to a first pressure, which pressure is preferably substantially at or near the hydrocracking zone 12 total pressure, and the effluent 34 is separated into a hydrocarbon liquid effluent stream 38 and a hydrogen-rich gas 8. The hydrogen-rich gas 8 is recycled to the hydrocracking zone 12. In a preferred variation of this embodiment, the first pressure, which is the reduced pressure of the first cooled stream 34, is a pressure substantially at or near the hydrocracking zone 12 total pressure, and preferably is in the range of about 1,000 psia to about 3,000 psia and a depressurized stream 38 comprising soluble foulant is formed. The hydrocarbon liquid effluent stream 38 is passed to a low pressure separator 42 where it is depressurized to a second pressure and light gases 44 are separated from the hydrocarbon liquid effluent stream 38 to form a low pressure hydrocracker product stream 46 and 60. The low pressure hydrocracker product stream 46 is fractionated in a fractionation zone 50 to separate the hydrocracker product stream 46 into desired lighter product cuts 52 and 54 and a heavy bottoms stream 2 containing unconverted hydrocarbons including a foulant. The heavy bottoms stream 2 is recycled to the hydrocracking zone 12. In a preferred variation, the second pressure of the stream 46 and 60 is in the range of about 250 psia to about 400 psia. More preferably, the second pressure is in the range of about 0 psia to about 300 psia. In a still more preferred variation, the second portion 60 of the depressurized stream is cooled in a second cooler 62 to a temperature in the range of about 85° F. to about 170° F. to form a colder second portion 66 comprising precipitated foulant. The precipitated foulant is removed from the colder second portion 66 by removal means 68 to form a reduced foulant colder second portion 80. In one variation, the precipitated foulant, which plates out in and fouls cooler 62 removed from the cooler 62 via conduit 64. In one variation of this embodiment of this invention, the improvement comprises partially cooling the hydrocracker effluent 22 in one or more first coolers 24 and 26. The hydrocracker effluent 22 is cooled to a temperature at which the foulant remain soluble to form a first cooled stream 34, 38, 46 and 60 comprising unprecipitated foulant. A portion 60 of the first cooled stream is withdrawn and the withdrawn portion 60 is cooled in a cooler 62 to a temperature, below the temperature of the first cooled stream 34, 38 and 46, at which the foulant precipitates to form a precipitated foulant 64 in the cooler 62 and second cooled stream 66 comprising precipitated foulant. The precipitated foulant 64 is removed from the cooler 62 and is removed from the second cooled stream 66 by a separator means 68 such as a filter or cyclone to form a third cooled stream 80 having a reduced concentration of foulant. The third cooled stream 80 is recycled to the hydrocracking zone 12. In the variation of this embodiment of this invention shown in FIG. 2, the third cooled stream is recycled via conduits 84 and 94 to the fractionator 50 for fractionation as part of the recycle to the hydrocracker 12.

In another variation of this embodiment of the invention as shown in FIG. 2, a treatment stream 60 is drawn from the bottom of the low pressure separator 42. The treatment stream 60 is a portion of, and has substantially the same concentration as, the liquid hydrocarbon effluent stream 46. The treatment stream 60 may have a slightly higher concentration of heavy hydrocarbons which tend to settle in the bottom of the separator 42. The treatment stream 60 is cooled in cooler 62 to a temperature at which the foulant in the treatment stream 62 precipitates. Preferable the treatment stream is cooled to a temperature in the range of about 85° F. to 170° F. A portion 64 of the foulant is removed from the process cooler 62. In anticipation of cooler fouling, the cooler 62 is selected from commercially available automatic tube cleaning or self cleaning process-side coolers. Such cooler is selected to avoid disassembly of the cooler to remove the precipitate. One such cooler is commercially available from WSA, Inc. Preferably, the cooler has the low pressure hydrocracker effluent flowing through the tubes, and the internal portion of the cooler on the process side of the tubes which have a brush in each tube and a basket or a filter means at the end of each tube. The brushes can flow into the basket or filter. Also, preferably the automatic cleaner will comprise an adjustable timer. At an interval set on the timer, the direction of flow of the process stream in the cooler tubes will be reversed and the brushes will sweep the foulant precipitate off from the tube walls and out of the cooler. The cooled treated stream 66 which contains precipitated foulant is passed to a separation means 68 to separate the foulant 70 from the process liquid 80. The process liquid 80 having a reduced concentration of foulant is recycled to the hydrocracker 22 via conduit 84 through the fractionator 50 bottoms recycle 2. The foulant 70 is withdrawn from the process via conduit 72 or is passed via conduit 74 to one or more separating means 76, such as a cyclone or a filter, for removal of foulant 78 and recycle of process liquid 82 via conduit 84 through the fractionator 50 bottoms recycle 22. One commercially available cyclone is Model PCl-30 from Krebs Engineers, Menlo Park, Calif. Pressure drop means 86 such as a valve or an orifice downstream of the low pressure separator decreases the pressure in conduit 46 from the pressure 88 of the effluent of the low pressure separator 42 to a pressure 90 less than the pressure 92 of the treated stream in conduit 84 to permit flow of the treated stream 84 to the fractionator 50.

Figure 3:
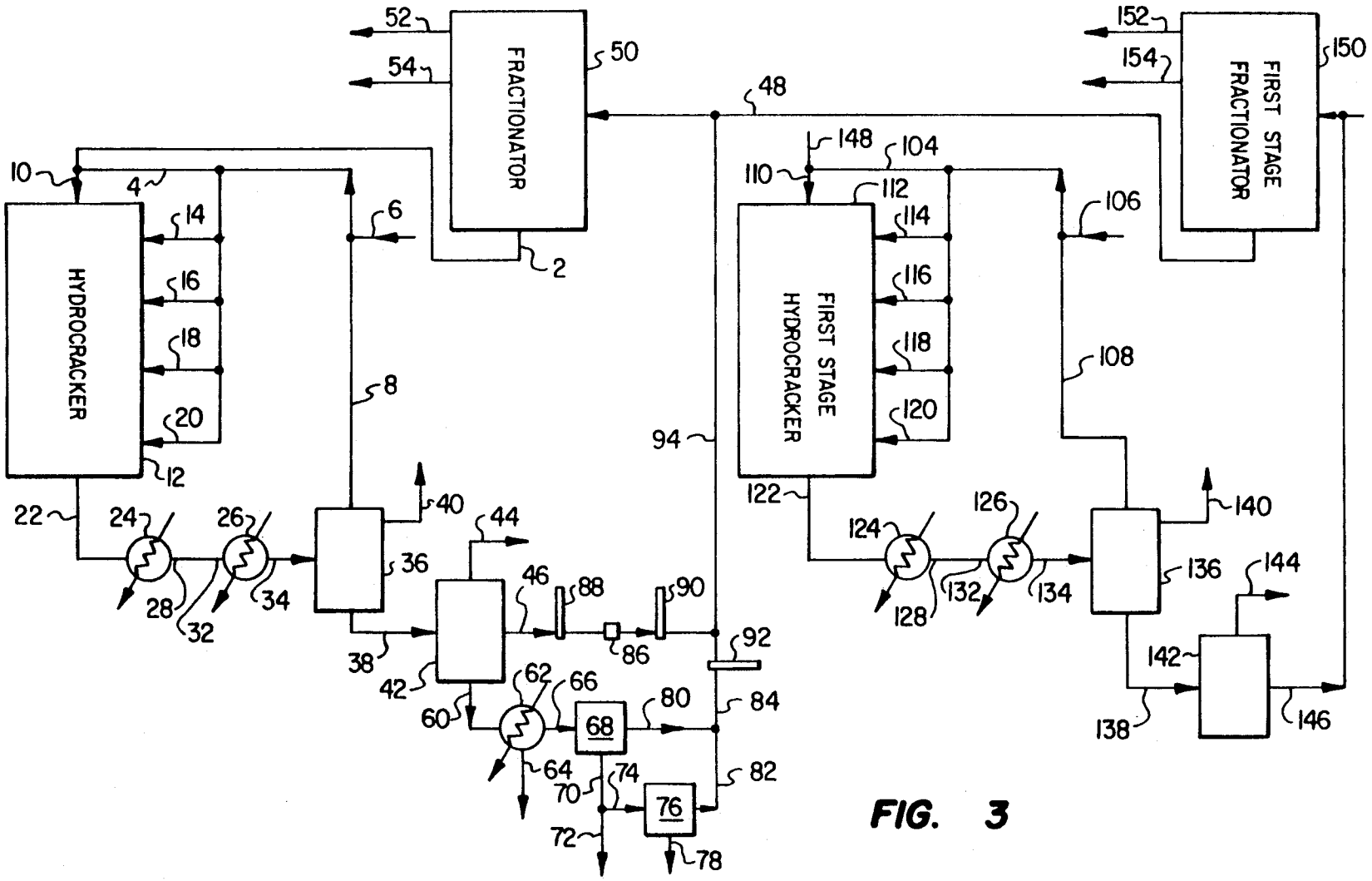

FIG. 3 is an embodiment of this invention, being an improved hydrocracking process having multi-stage hydrocracking and multi-stage fractionation. In the discussion of FIG. 3, the same numbers as used in FIGS. 1 and 2 will be used in FIG. 3 to refer to the same or similar items. In FIG. 3, the fresh hydrocarbon feed 48 comprises hydrocracked hydrocarbon feed. The hydrocracked hydrocarbon feed 48 is fed to the fractionating zone 50 with a reduced foulant colder second portion 92 and a first portion 46 of the depressurized stream from the low pressure separator 42. The hydrocracked hydrocarbon feed 48 could be fed directly to the hydrocracker 12. In a similar manner, the fresh hydrocarbon feed 148 to the first stage hydrocracker 112 can be hydrocracker hydrocarbon feed. In the preferred variation of this embodiment shown in FIG. 3, the fresh hydrocarbon feed 148 comprises hydrotreated hydrocarbon feed from a hydrotreater (not shown) and is fed directly to the first stage hydrocracker 112.

In the embodiment of FIG. 3, the improved catalytic hydrocracking process converts the heavy hydrocarbon feed 148 to lower boiling products 48, 152, and 154. To the hydrocracking zone 112, the hydrocarbon feed 148 and a hydrogen-rich gas 104, 114, 116, 118, and 120 are fed, in the presence of a hydrocracking catalyst (not shown) at hydrocracking temperature and pressure to produce a hydrocracker effluent 122 comprising converted and unconverted components, including a foulant, of the feed 2. The hydrocracker effluent 122 is cooled in coolers 124 and 126 and passed via conduit 134 to a high pressure separator 136 where the hydrocracker effluent 122 is depressurized to a first pressure and separated into a hydrocarbon liquid effluent stream 138 and a hydrogen-rich gas 108 which is recycled to the hydrocracking zone !12. The hydrocarbon liquid effluent stream 138 is passed to a low pressure separator 142 where it is depressurized to second pressure and light gases 144 are separated from the hydrocarbon liquid stream 138 to form a low pressure hydrocracker product stream 146. The low pressure hydrocracker product stream 146 is fractionated in a fractionation zone 150 to separate the hydrocracker product stream 146 into a desired lighter product cut 152 and a heavy bottoms stream 48 containing unconverted hydrocarbons including a foulant. In the embodiment shown in FIG. 3, the heavy bottoms stream 48 is not recycled to the first stage hydrocracking zone 112. Since the fractionated hydrocracker effluent 48 is not recycled to the first stage hydrocracker, the concentration of foulant in the hydrocracker effluent 22 does not increase due to recycle and accumulation of foulant. In this embodiment, the foulant removal process and apparatus of FIG. 2 are not employed with the low pressure effluent 146 of the first hydrocracking zone of FIG. 3. If changes in feedstocks, refinery operating conditions, recycle of a portion of stream 48 to reactor 112, or other process changes result in the concentration of foulant in the hydrocarbon feed 110 being such that the limit of solubility of foulant in the reactor effluent 122 would be exceeded, then the foulant removal methods of this invention would be employed to prevent fouling of coolers 124 and 126.

While the invention has been described in conjunction with presently preferred embodiments, it is obviously not limited thereto. For example, those skilled in the art understand that in implementing the teachings of this invention with respect to the term "first cooler", as well as the term "second cooler", that one or more cooling apparatus, including various combinations of designs employing alternative heat transfer media such as water, air, process recycle streams and the like, can be employed in combination to serve as a single cooler.

We claim:

1. A catalytic hydrocracking process which comprises:

a. contacting a hydrocarbon feed comprising polycyclic aromatics in a hydrocracking zone with added hydrogen in the presence of a hydrocracking catalyst at an elevated temperature and pressure, sufficient to cause substantial conversion of said feed to lower boiling products, to produce a hydrocracking zone effluent comprising converted products, unconverted hydrocarbons and polycyclic aromatics;

b. cooling in a first cooler said hydrocracking zone effluent to a first temperature at which said are polycyclic aromatics soluble in said effluent to effect condensation of a condensed stream comprising soluble polycyclic aromatics;

c. depressurizing said condensed stream to form a depressurized condensed stream comprising soluble polycyclic aromatics;

d. cooling in a second cooler a portion of said depressurized condensed stream to a second temperature, below said first temperature of said condensed stream, at which precipitation of polycyclic aromatics occur to form a low temperature stream comprising precipitated polycyclic aromatics;

e. removing at least a portion of said precipitated polycyclic aromatics from said low temperature stream to form a reduced polycyclic aromatics recycle stream;

f. fractionating a fresh hydrocarbon feed comprising polycyclic aromatics, said depressurized condensed stream comprising soluble polycyclic aromatics and said reduced polycyclic aromatics recycle stream in to a first fraction comprising lower boiling products and a second fraction comprising unconverted hydrocarbons and polycyclic aromatics; and, g. recycling said second fraction to said hydrocracking zone as hydrocarbon feed.

2. A process in accordance with claim 1 wherein said hydrocracking zone effluent is cooled to a first temperature in the range of about 170° F. to about 300° F.

3. A process in accordance with claim 1 wherein said depressurized condensed stream is cooled to a second temperature in the range of about 85° F. to about 170° F.

4. A process in accordance with claim 1 wherein said portion of precipitated polycyclic aromatics removed from said low temperature stream is in an amount at least equal to an amount sufficient to maintain the concentration of polycyclic aromatics in said condensed stream at said first temperature below the soluble concentration of polycyclic aromatics in said condensed stream at said first temperature.

5. A process in accordance with claim 1 wherein said precipitated polycyclic aromatics forms a polycyclic aromatics precipitate in said second cooler and said polycyclic aromatics precipitate is removed from said second cooler.

6. A process in accordance with claim 1 wherein said hydrocarbon feed comprises a portion of said reduced polycyclic aromatics recycle stream.

7. A process in accordance with claim 1 wherein said fresh hydrocarbon feed comprises a component selected from the group consisting of atmospheric gas oil, vacuum gas oil, cracked gas oil, catalytic cycle oil, and coker gas oil.

8. A process in accordance with claim 1 wherein said fresh hydrocarbon feed comprises hydrotreated hydrocarbon feed.

9. A process in accordance with claim 1 wherein said fresh hydrocarbon feed comprises hydrocracked hydrocarbon feed.

10. A process in accordance with claim 1 wherein said hydrocracking zone is maintained at an elevated total pressure in the range of about 1,000 psia to 3,000 psia.

11. A process in accordance with claim 1 wherein said condensed stream is depressurized from a hydrocracking zone pressure in the range of about 1,000 psia to 3,000 psia to a pressure in the range of about 0 psia to about 300 psia.

12. A process in accordance with claim 1 wherein said hydrocracking zone is maintained at an elevated temperature in the range of about 450° F. to about 850° F.

13. A process in accordance with claim 1 wherein said hydrocracking catalyst comprises palladium and a zeolite base.

14. A hydrocracking process for converting a hydrocarbon feed into lighter petroleum products, wherein said feed comprises polycyclic aromatics, comprising:

a. feeding said hydrocarbon feed and hydrogen to a hydrocracking zone having a hydrocracking catalyst at hydrocracking conditions of elevated temperature and pressure to produce a hydrocracking effluent stream comprising polycyclic aromatics;

b. cooling said hydrocracking effluent stream in a first cooler to a temperature in the range of about 170° F. to about 300° F. to form a first cooled stream comprising soluble polycyclic aromatics;

c. reducing the pressure of said first cooled stream to a pressure in the range of about 0 psia to about 300 psia to form a depressurized stream comprising soluble polycyclic aromatics;

d. separating said depressurized stream into a first portion comprising soluble polycyclic aromatics and a second portion comprising soluble polycyclic aromatics;

e. cooling said second portion of said depressurized stream in a second cooler to a temperature in the range of about 85° F. to about 170° F. to form a colder second portion comprising precipitated polycyclic aromatics;

f. removing said precipitated polycyclic aromatics from said colder second portion to form a reduced polycyclic aromatics colder second portion;

g. feeding said reduced polycyclic aromatics colder second portion and said first portion of said depressurized stream to a fractionating zone;

h. fractionating said first portion and said reduced polycyclic aromatics colder second portion in to a lighter petroleum product fraction and a heavier fraction comprising polycyclic aromatics; and i. recycling said heavier fraction to said hydrocracker.

15. A process in accordance with claim 14 wherein said polycyclic aromatics precipitate is removed form said second cooler and said precipitated polycyclic aromatics is removed from said colder second portion to maintain the concentration of polycyclic aromatics in said depressurized stream below the concentration at which polycyclic aromatics are no longer soluble in said depressurized stream.

16. A process in accordance with claim 14 wherein said hydrocarbon feed to said hydrocracking zone comprises a portion of said reduced polycyclic aromatics colder second portion.

17. A process in accordance with claim 14 wherein said feed to said fractionating zone comprises fresh hydrocarbon feed comprising a component selected from the group consisting of atmospheric gas oil, vacuum gas oil, cracked gas oil, catalytic cycle oil, and coker gas oil.

18. A process in accordance with claim 14 wherein said feed to said fractionating zone comprises fresh hydrocarbon feed comprising hydrotreated hydrocarbon feed.

19. A process in accordance with claim 14 wherein said feed to said fractionating zone comprises fresh hydrocarbon feed comprising hydrocracked hydrocarbon feed.

20. A process in accordance with claim 14 wherein said hydrocracking zone is maintained at an elevated total pressure in the range of about 1,000 psia to 3,000 psia.

21. A process in accordance with claim 14 wherein said hydrocracking zone is maintained at an elevated temperature in the range of about 450° F. to about 850° F.

22. A process in accordance with claim 14 wherein said hydrocracking catalyst comprises palladium and a zeolite base.

23. A hydrocracking process for conversion of a heavy hydrocarbon feed to a lower boiling product, wherein said heavy hydrocarbon feed comprises polycyclic aromatics, comprising:

a. contacting said heavy hydrocarbon feed in a hydrocracker with a hydrogen-rich first gas fraction in the presence of a hydrocracking catalyst at hydrocracking conditions to convert said heavy hydrocarbon feed to a hydrocracker product stream;

b. cooling said hydrocracker product stream in a first cooler to a first cool temperature at which polycyclic aromatics remains soluble in said hydrocracker product stream to form a cooled hydrocracker product stream comprising soluble polycyclic aromatics;

c. separating said cooled hydrocracker product stream in a first separation zone in to a first gas fraction comprising hydrogen and a first separation zone liquid effluent comprising soluble polycyclic aromatics;

d. adjusting the concentration of hydrogen in said first gas fraction to form a hydrogen-rich first gas fraction;

e. recycling said hydrogen-rich first gas fraction to said hydrocracker;

f. separating said first separation zone liquid effluent in a second separate separation zone in to a second gas fraction and a second separation zone liquid effluent comprising soluble polycyclic aromatics;

g. separating said second separation zone liquid effluent in to a first portion comprising soluble polycyclic aromatics and a second portion comprising soluble polycyclic aromatics;

h. cooling said second portion of said second separation zone liquid effluent in a second cooler to a second cool temperature sufficient to precipitate polycyclic aromatics from said second portion to form polycyclic aromatics precipitate;

i. removing said polycyclic aromatics precipitate from said second portion of said second separation zone liquid effluent and separating said second portion of said second separation zone liquid effluent in to a polycyclic aromatics-lean stream and a polycyclic aromatics-rich stream;

withdrawing said polycyclic aromatics-rich stream from said process;

k. feeding said first portion of second separation zone liquid effluent and said polycyclic aromatics-lean stream as feed to a fractionation zone for fractionization in to a heavy hydrocarbon fraction containing polycyclic aromatics and a lower boiling point fraction;

l. recycling said heavy hydrocarbon fraction to said hydrocracker as hydrocarbon feed; and, m. recovering said lower boiling fraction as a lower boiling product.

24. A process in accordance with claim 23 wherein said polycyclic aromatics precipitate precipitates in said second cooler and said polycyclic aromatics precipitate is removed from said second cooler.

25. A process in accordance with claim 23 wherein said polycyclic aromatics precipitate is removed from said second cooler and said second separation zone liquid effluent to maintain the concentration of polycyclic aromatics in said cooled hydrocracker product stream below the concentration at which polycyclic aromatics are no longer soluble in said cooled hydrocracker product stream.

26. A process in accordance with claim 23 wherein said hydrocarbon feed to said hydrocracker comprises a portion of said polycyclic aromatics-lean stream.

27. A process in accordance with claim 23 wherein said feed to said fractionating zone comprises fresh hydrocarbon feed comprising a component selected from the group consisting of atmospheric gas oil, vacuum gas oil, cracked gas oil, catalytic cycle oil, and coker gas oil.

28. A process in accordance with claim 23 wherein said feed to said fractionating zone comprises fresh hydrocarbon feed comprising hydrotreated hydrocarbon feed.

29. A process in accordance with claim 23 wherein said feed to said fractionating zone comprises fresh hydrocarbon feed comprising hydrocracked hydrocarbon feed.

30. A process in accordance with claim 23 wherein said hydrocracker is maintained at an elevated total pressure in the range of about 1,000 psia to 3,000 psia.

31. A process in accordance with claim 23 wherein said hydrocracker is maintained at an elevated temperature in the range of about 450° F. to about 850° F.

32. A process in accordance with claim 23 wherein said hydrocracking catalyst comprises palladium and a zeolite base.

33. In a hydrocracking process for conversion of components of a heavy hydrocarbon feed to lighter, more valuable products, wherein said feed comprises polycyclic aromatics, comprising:

a. contacting said feed with hydrogen, in the presence of a hydrocracking catalyst, at an elevated temperature and pressure in a hydrocracker, to produce a hydrocracker effluent comprising polycyclic aromatics;

b. cooling and depressurizing said hydrocracker effluent to form a cooled, depressurized hydrocracker effluent comprising polycyclic aromatics;

c. separating said cooled, depressurized hydrocracker effluent in to the products of the conversion and an unconverted portion of the hydrocracker effluent which comprises polycyclic aromatics; and, d. recycling, as effluent recycle to said hydrocracker, said unconverted portion of said hydrocracker effluent to said hydrocracker, wherein the concentration of polycyclic aromatics in said hydrocracker effluent is increased;

the improvement comprising:

i. partially cooling said hydrocracker effluent in a first cooler to a temperature at which said polycyclic aromatics remains soluble in said hydrocracker effluent to form a first cooled stream comprising unprecipitated polycyclic aromatics;

ii. withdrawing a withdrawn portion of said first cooled stream and cooling said withdrawn portion to a temperature, below said temperature of said first cooled stream, at which polycyclic aromatics precipitate to form a second cooled stream comprising precipitated polycyclic aromatics;

iii. removing said precipitated polycyclic aromatics from said second cooled stream to form a third cooled stream having a reduced concentration of polycyclic aromatics; and, iv. recycling said third cooled stream to said hydrocracker to reduce said concentration of polycyclic aromatics in said hydrocracker effluent.

34. In a catalytic hydrocracking process for converting a heavy hydrocarbon feed comprising polycyclic aromatics to lower boiling products, said process comprising:

a. contacting said feed and a hydrogen-rich gas, in a hydrocracker, in the presence of a hydrocracking catalyst at hydrocracking temperature and pressure to produce a hydrocracker effluent comprising converted components of said feed and unconverted components of said feed comprising polycyclic aromatics;

b. cooling said hydrocracker effluent;

c. passing said hydrocracker effluent to a high pressure separator where said hydrocracker effluent is depressurized to a first pressure and separated into a hydrocarbon liquid effluent stream and a hydrogen-rich gas;

d. recycling said hydrogen-rich gas to said hydrocracker;

e. passing said hydrocarbon liquid effluent stream to a low pressure separator where said hydrocarbon liquid effluent is depressurized to a second pressure and light gases are separated from said hydrocarbon liquid stream to form a low pressure hydrocracker product stream;

f. fractionating said low pressure hydrocracker product stream in a fractionation zone to separate said low pressure hydrocracker product stream into desired lighter product cuts and a heavy bottoms stream containing unconverted hydrocarbons comprising polycyclic aromatics;

g. recycling said heavy bottoms stream to said hydrocracking zone;

the improvement comprising, i. cooling said hydrocracker effluent in a first cooler to a temperature at which polycyclic aromatics remains soluble in said hydrocracker effluent to form a first cooled stream comprising unprecipitated polycyclic aromatics;

ii. passing said first cooled stream to a high pressure separator where said first cooled stream is depressurized to a first pressure and separated in to a hydrocarbon liquid effluent stream comprising unprecipitated polycyclic aromatics and a hydrogen-rich gas;

iii. recycling said hydrogen-rich gas to said hydrocracker;

iv. passing said hydrocarbon liquid effluent stream to a low pressure separator where said hydrocarbon liquid effluent stream is depressurized to a second pressure and light gases are separated from said hydrocarbon liquid effluent stream to form at a cool temperature a low pressure hydrocracker product stream comprising unprecipitated polycyclic aromatics;

v. withdrawing a withdrawn portion of said low pressure hydrocracker product stream and cooling in a second cooler said withdrawn portion to a temperature, below said cool temperature of said low pressure hydrocracker product stream, at which polycyclic aromatics precipitate to form a polycyclic aromatics precipitate in said second cooler and a second cooled stream comprising precipitated polycyclic aromatics;

vi. removing said polycyclic aromatics precipitate rom said second cooler;

vii. removing said precipitated polycyclic aromatics from said second cooled stream to form a third cooled stream having a reduced concentration of polycyclic aromatics; and, viii. recycling said third cooled stream to said hydrocracking zone.

35. A process in accordance with claim 33 or 34 wherein said heavy hydrocarbon feed comprises a component selected from the group consisting of atmospheric gas oil, vacuum gas oil, cracked gas oil, catalytic cycle oil, and coker gas oil.

36. A process in accordance with claim 33 or 34 wherein said heavy hydrocarbon feed comprises hydrotreated hydrocarbon feed.

37. A process in accordance with claim 33 or 34 wherein said heavy hydrocarbon feed comprises hydrocracked hydrocarbon feed.

38. A process in accordance with claim 33 or 34 wherein said hydrocracker is maintained at an elevated total pressure in the range of about 1,000 psia to 3,000 psia.

39. A process in accordance with claim 33 or 34 wherein said hydrocracker is maintained at an elevated temperature in the range of about 450° F. to about 850° F.

40. A process in accordance with claim 33 or 34 wherein said hydrocracker catalyst comprises palladium and a zeolite base.

* * * * *

UNITED STATES PATENT AND TRADEMARK OFFICE

CERTIFICATE OF CORRECTION

PATENT NO. : 5,120,426

DATED : June 9, 1992

INVENTOR(S) : Mark R. Johnston, et al.

It is certified that error appears in the above-identified patent and that said Letters Patent is hereby corrected as shown below:

Column 15, line 66, "form" should read - - - from - - -.

Column 17, line 10, insert - - - j. - - - at the beginning of the paragraph.

Column 20, line 2, "rom" should read - - - from - - -.

Signed and Sealed this

Thirty-first Day of August, 1993

Bruce Lehman

*Attest:*

BRUCE LEHMAN

*Attesting Officer*

*Commissioner of Patents and Trademarks*